US007328595B2

(12) United States Patent
Lonati et al.

(10) Patent No.: US 7,328,595 B2
(45) Date of Patent: Feb. 12, 2008

(54) METHOD FOR MANUFACTURING KNITTED ARTICLES WITH A CIRCULAR KNITTING MACHINE FOR FORMING ITEMS OF CLOTHING WITHOUT LATERAL SEAMS

(75) Inventors: Ettore Lonati, Brescia (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 10/561,903

(22) PCT Filed: Jun. 22, 2004

(86) PCT No.: PCT/EP2004/006731

§ 371 (c)(1),
(2), (4) Date: Dec. 21, 2005

(87) PCT Pub. No.: WO2005/003420

PCT Pub. Date: Jan. 13, 2005

(65) Prior Publication Data

US 2007/0095109 A1 May 3, 2007

(30) Foreign Application Priority Data

Jul. 3, 2003 (IT) ..... MI2003A1368

(51) Int. Cl.
*D04B 1/24* (2006.01)

(52) U.S. Cl. ..... 66/176

(58) Field of Classification Search ..... 66/8, 66/171, 179–188, 176, 177
See application file for complete search history.

(56) References Cited

U.S. PATENT DOCUMENTS

| | | | | |
|---|---|---|---|---|
| 1,072,640 | A | 9/1913 | Nydegger | |
| 3,601,818 | A * | 8/1971 | Chesebro et al. | 66/171 |
| 4,010,627 | A | 3/1977 | Pernick | |
| 4,038,699 | A | 8/1977 | Burn | |
| 4,048,819 | A | 9/1977 | Johnson | |
| 5,592,836 | A * | 1/1997 | Schuster et al. | 66/176 |
| 6,003,345 | A * | 12/1999 | Jordan | 66/215 |
| 6,209,363 | B1 * | 4/2001 | Jordan | 66/215 |
| 6,460,380 | B1 | 10/2002 | Sciacca | |
| 7,076,973 | B1 * | 7/2006 | Chesebro et al. | 66/178 R |

FOREIGN PATENT DOCUMENTS

| | | |
|---|---|---|
| GB | 1 078 462 A | 8/1967 |
| GB | 1 328 693 A | 8/1973 |

* cited by examiner

*Primary Examiner*—Danny Worrell
(74) *Attorney, Agent, or Firm*—Modiano & Associati; Albert Josif; Daniel J. O'Byrne

(57) ABSTRACT

A method for manufacturing knitted articles for forming items of clothing, such as body suits, sleeveless tops, undershirts, bras, underpants or the like, without lateral seams, with a circular knitting machine, comprising at least one tab forming step, in which all or some of the needles that belong to at least one sector of the needle cylinder are moved to knit at at least one feed or drop of the machine, the needle cylinder of the machine being actuated with alternating rotary motion about its own axis, with an oscillation extent sufficient to produce transit, at the at least one feed, of all the needles of the at least one sector that are moved to knit at that feed, in order to make these needles form a preset number of rows of knitting.

12 Claims, 4 Drawing Sheets

METHOD FOR MANUFACTURING KNITTED ARTICLES WITH A CIRCULAR KNITTING MACHINE FOR FORMING ITEMS OF CLOTHING WITHOUT LATERAL SEAMS

TECHNICAL FIELD

The present invention relates to a method for manufacturing knitted articles for forming items of clothing, such as body suits, sleeveless tops, undershirts, bras, underpants or the like, without lateral seams, with a circular knitting machine.

BACKGROUND ART

As is known, in the production of knitted articles for forming items of clothing of the type of body suits, sleeveless tops, undershirts, bras, underpants or the like without lateral seams by using circular knitting machines, one of the main problems is the formation of the tabs that are designed to constitute the shoulder straps of the item of clothing or the front region and rear region of underpants or, more generally, solid regions of the article alternated with empty regions in the circumferential extension of the article. With the methods currently in use, these tabs are in fact obtained by removing, by cutting, at the end of the production of the article, which is formed monolithically in a tubular shape, the excess regions of the article, i.e., the regions of the article that are contiguous to the tabs to be obtained, which are then generally sewn together so as to close for example the shoulder strap or the crotch region of underpants.

In some cases, the portions of the article that are to be removed are produced with lower-value threads or with a smaller number of rows of knitting with respect to the remaining part of the article, so as to reduce the economic loss caused by waste.

As an alternative, these tabs are also obtained, directly during the formation of the article, by actuating the needle cylinder with a continuous rotary motion about its own axis and by cutting, in each instance, the threads used to form the tabs at the end of the formation of each row of the knitting that forms the corresponding tab.

In any case, owing to the fact that provision of the tabs requires cutting portions of the article or the threads at the edges of the tabs, an unsatisfactory finish effect is obtained, which requires additional work to obtain the finished product, such as for example the provision of hems or the application of finishing borders.

DISCLOSURE OF THE INVENTION

The aim of the present invention is to solve the problem described above by providing a method for manufacturing knitted articles for forming items of clothing such as body suits, sleeveless tops, undershirts, bras, underpants or the like, without lateral seams, with a circular knitting machine, which allows to obtain tabs, designed to constitute in particular shoulder straps of the items of clothing, or the front and rear regions of underpants, which do not require further finishing operations after the production of the article on the circular knitting machine.

Within this aim, an object of the invention is to provide a method that allows to obtain a tubular knitted article with tabs that have an excellent degree of finish at the lateral edges.

Another object of the invention is to provide a method that allows to eliminate the waste required to produce the tabs.

Another object of the invention is to provide a method that allows to produce knitted articles with the productivity that is typical of circular knitting machines and with a degree of finish that can be compared to what is obtainable with rectilinear knitting machines.

This aim and these and other objects that will become better apparent hereinafter are achieved by a method for manufacturing knitted articles for forming items of clothing, such as body suits, sleeveless tops, undershirts, bras, underpants or the like, without lateral seams, with a circular knitting machine, characterized in that it comprises at least one step for forming tabs, in which exclusively all or some of the needles that belong to a sector of the needle cylinder are moved so as to knit at at least one feed or drop of the machine, and the needle cylinder of the machine is actuated with an alternating rotary motion about its own axis, with an extent of oscillation that is sufficient to produce the transit, at said at least one feed, of all the needles of said at least one sector that are moved to knit at said at least one feed, in order to make the needles of said at least one sector that are moved to knit at said at least one feed form a preset number of rows of knitting.

BRIEF DESCRIPTION OF THE DRAWINGS

Further characteristics and advantages of the invention will become better apparent from the description of preferred but not exclusive embodiments of the method according to the invention, illustrated by way of non-limiting example in the accompanying drawings, wherein.

Figure 2:
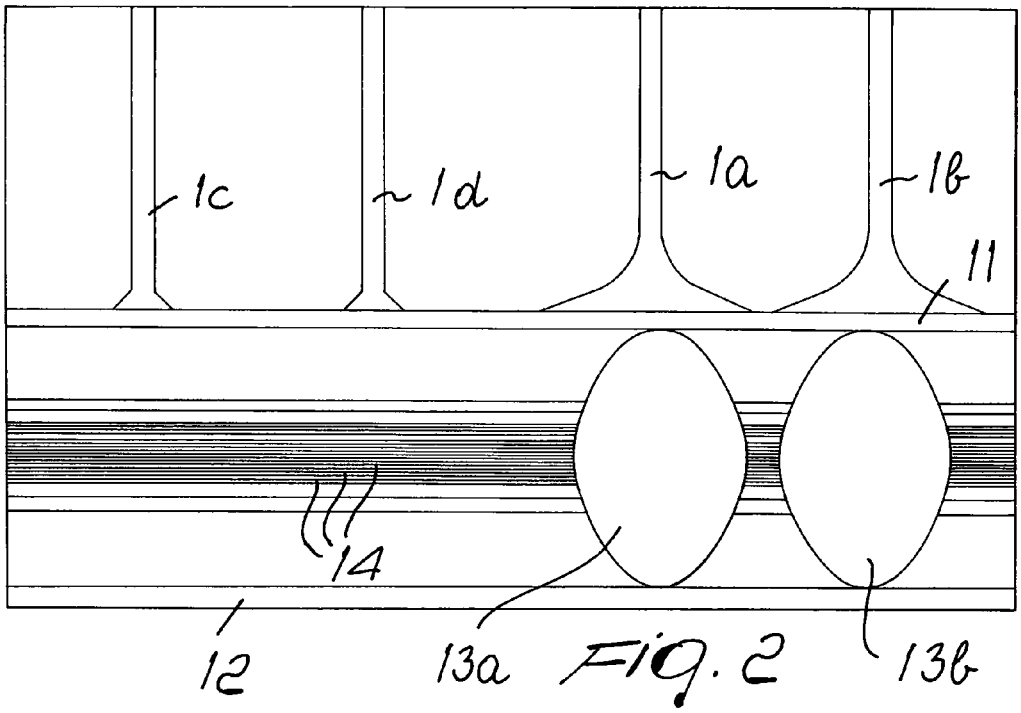
FIG. 2 is a diagram of the production of the article for forming the bra of FIG. 1.

The method according to the invention can be performed with circular knitting machines in which the needle cylinder can be actuated with a rotary motion about its own axis in both directions of rotation, for example a machine of the type described in a co-pending Patent Application by the same Applicant.

WAYS TO CARRYING OUT THE INVENTION

With reference to the figures, the method according to the invention comprises at least one step for forming tabs 1*a*, 1*b*, 1*c*, 1*d*, 2*a*, 2*b*, 2*c*, 2*d*, 3*a*, 3*b* that are designed to constitute in particular, as in the case of the tabs 1*a*-1*d*, the shoulder straps of a bra 10 or, as in the case of the tabs 2*a*-2*d*, the shoulder straps of an undershirt or vest 20, or, as in the case of the tabs 3*a* and 3*b*, the rear and front regions of a pair of underpants 30. In this step for forming the tabs 1*a*-1*d*, 2*a*-*d*, 3*a* and 3*b*, all or some of the needles that belong to at least one sector of the needle cylinder are moved to knit at at least one preset feed or drop of the machine, and the needle cylinder is actuated with an alternating rotary motion abouts its own axis with an extent of oscillation that is sufficient to produce the transit, at said feed, of all the needles of the corresponding sector that are moved to knit, forming a preset number of rows of knitting, depending on the length chosen for the tabs 1*a*-1*d*, 2*a*-2*d* and 3*a*, 3*b*.

Since the needle cylinder is actuated with an alternating rotary motion about its own axis, at the end of the formation of a row of knitting of the tab or tabs, the direction of rotation of the needle cylinder is reversed and the thread that is used does not have to be cut, but is used to produce the subsequent row of knitting produced by actuating the needle cylinder in the opposite direction. In this manner, the lateral edges of the tabs 1*a*-1*d*, 2*a*-2*d* and 3*a*, 3*b* do not have cut trailing threads and therefore are already finished with an excellent degree of finish.

Preferably, during the formation of the tabs 1*a*-1*d*, 2*a*-2*d*, 3*a* and 3*b*, a preset number of needles located at the lateral ends of the sector or sectors used to produce said tabs is actuated at the feed being considered according to a selection in which needles are inactive in a one-to-one configuration, i.e., considering a set of needles located at the ends of a sector, alternately, during a rotation in one direction of the needle cylinder, one needle of this set is deactivated and passes, with its hook, below the sinkers of the machine, while the contiguous needle is moved so as to knit at the feed being considered and forms a dropped stitch; during the motion of the needle cylinder in the opposite direction, the needle, previously excluded from knitting, is moved so as to knit, while the contiguous needle is moved so as to be inactive.

As an alternative, during the formation of the tabs 1*a*-1*d*, 2*a*-2*d*, 3*a* and 3*b*, a preset number of needles located at the lateral ends of the sector or sectors used to produce said tabs can be actuated, at the feed being considered, according to a selection in which needles are in a one-to-one tuck-stitch position, i.e., considering a set of needles located at the ends of a sector, alternately, during a rotation of the needle cylinder in one direction, one needle of this set is lifted to the tuck-stitch level so as to engage the thread supplied at the feed being considered without releasing the previously formed loop, while the contiguous needle is moved so as to knit at the feed being considered and forms a dropped stitch; during the motion of the needle cylinder in the opposite direction, the needle that previously had been raised to the tuck-stitch level is actuated so as to form a dropped stitch, while the contiguous needle is raised to the tuck-stitch level.

The breadth of the sector or sectors in which the needles to be used to form the tab or tabs to be provided are arranged, and the number of needles of said sector or sectors that are moved to knit, may be changed during knitting, according to a preset program, so as to obtain the intended shape for the tab or tabs.

The step for forming the tab or tabs 1*a*-1*d*, 2*a*-2*d*, 3*a* and 3*b* may be preceded or followed by a step for forming a tubular portion of knitting 11, 12, 21, 22, 24, 31, in which needles distributed along the entire circumferential extension of the needle cylinder of the machine are moved to knit at at least one feed or drop of the machine and the needle cylinder is actuated preferably with a continuous rotary motion about its own axis.

In greater detail, with particular reference to FIGS. 1 and 2, one proceeds as follows to produce an article for forming a bra 10.

Initially, the tabs 1*a*, 1*b*, 1*c*, 1*d* are produced by using all or part of the needles of the machine that are arranged in four sectors of the needle cylinder that are angularly spaced from each other around the axis of the needle cylinder. Each sector is correlated to a feed or drop of the machine, at which all or some of the needles of that given sector are moved to knit. The needle cylinder is actuated with an alternating rotary motion about its own axis so as to form, at each forward or return motion of the needle cylinder about its own axis, a row of knitting of the tabs 1*a*, 1*b*, 1*c*, 1*d*. Knitting is preferably produced, proximate to the lateral ends of the tabs, by means of a selection with needles that are inactive or in the tuck-stitch position in a one-to-one configuration, as described above, which has the effect of giving greater consistency to the lateral edges of the tabs. Proximate to the end of the formation of the tabs, the number of needles moved to knit for each sector and/or the breadth of the sectors can be increased so as to blend the tabs with the remaining part of the article.

At the end of the formation of the tabs 1*a*-1*d*, the needle cylinder is actuated with a continuous rotary motion about its own axis, and the needles of the machine are moved so as to knit preferably at all the feeds of the machine, so as to rapidly form a tubular portion of knitting 11.

At the end of this tubular portion 11, the needles that will be excluded from knitting in the subsequent step retain the last loop of knitting in their hook and are kept lowered so that their hook lies below the knockover plane of the sinkers of the machine.

In the subsequent step, the two cups 13*a*, 13*b* of the bra are formed. During this step, all or some of the needles of two sectors of the needle cylinder that are angularly spaced from each other around the axis of the needle cylinder are used, and the needle cylinder is actuated with an alternating rotary motion about its own axis. The needles that belong to one sector are moved so as to knit at one feed of the machine, while the needles that belong to the other sector are moved so as to knit at another feed of the machine. The number of needles of each sector that knit at the corresponding feed is gradually increased and then gradually decreased, so as to achieve the intended shape of the corresponding cup. The needles of the two sectors that are actuated at the two feeds produce rows of knitting in excess with respect to the other needles of the machine, thus forming the two cups of the bra.

It should be noted that the shaping of the two cups 13*a*, 13*b* of the bra can be improved by producing, in addition to the rows of knitting formed only with the needles that belong to the two sectors, rows of knitting 14 formed by using all the needles of the machine or otherwise distributed along the entire circumferential extension of the needle cylinder.

Optionally, by using suitable needle selections, such as for example inactive needles or needles in the tuck-stitch position, it is possible to obtain, at the lower part of the cups or proximate to the borders of the cups or in other regions, reinforcement areas suitable to support or shape the breast.

After forming the cups 13*a*, 13*b*, another tubular portion of knitting 12 is formed by using all the needles of the needle cylinder or part of said needles distributed along the entire circumferential extension of the needle cylinder and by using all or part of the feeds of the machine. This tubular portion 12, which constitutes a knitting completion border, can be produced entirely or partially as a folded double border, in a per se known manner.

The article is then disengaged from the needles and unloaded from the machine. To finish the bra 10, it is sufficient to join, by sewing, the ends of the tabs 1*a*, 1*d* and 1*b*, 1*c* in order to close the shoulder straps.

Figure 3:
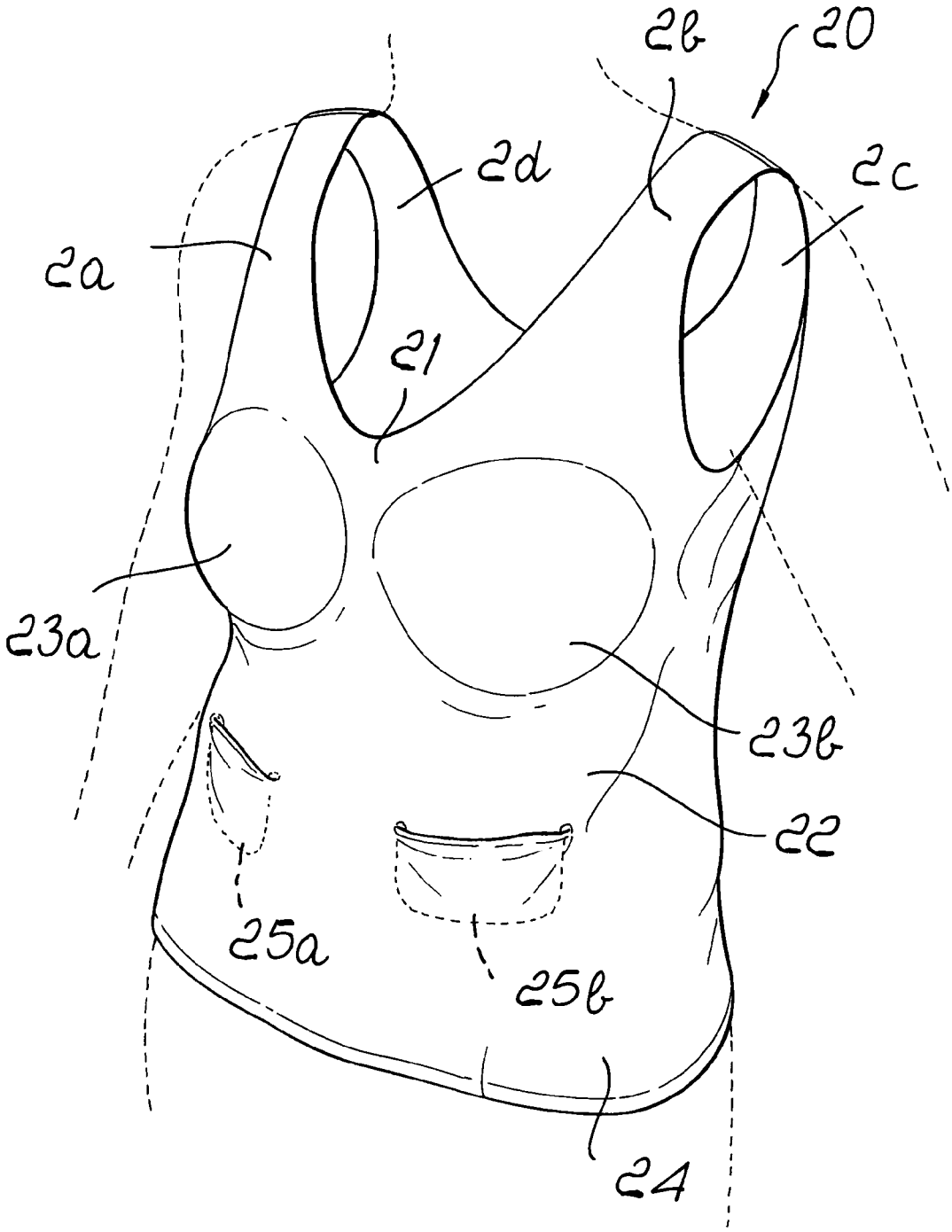
FIG. 3 is a view of an undershirt obtained with an article produced with the method according to the invention.
Figure 4:
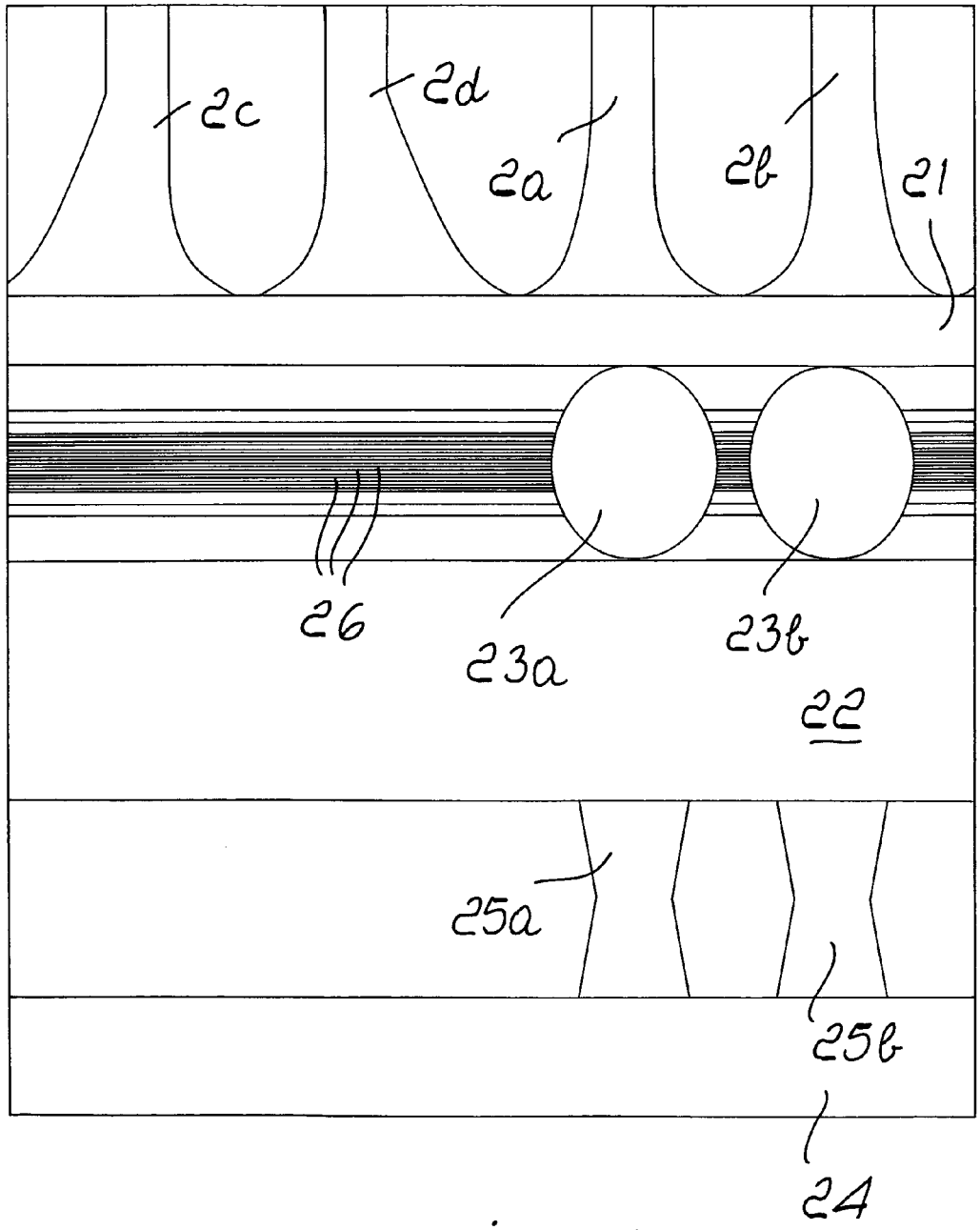
FIG. 4 is a diagram for the production of the article for forming the undershirt of FIG. 3.

With particular reference to FIGS. 3 and 4, one proceeds as follows to produce an article for forming an undershirt 20.

Initially, the tabs 2*a*-2*d* are produced, in a manner similar to the one already described with reference to FIGS. 1 and 2. After producing the tabs 2*a*-2*d*, the article can be completed simply by producing a tubular portion of knitting of adequate length, by actuating the needle cylinder with a continuous rotary motion about its own axis and by moving so as to knit all the needles of the machine or part of said needles, distributed along the entire circumferential extension of the needle cylinder at all the feeds of the machine or at some of them, and by ending the knitting of the article with a knitting completion border, optionally produced as a folded double border.

Figure 1:
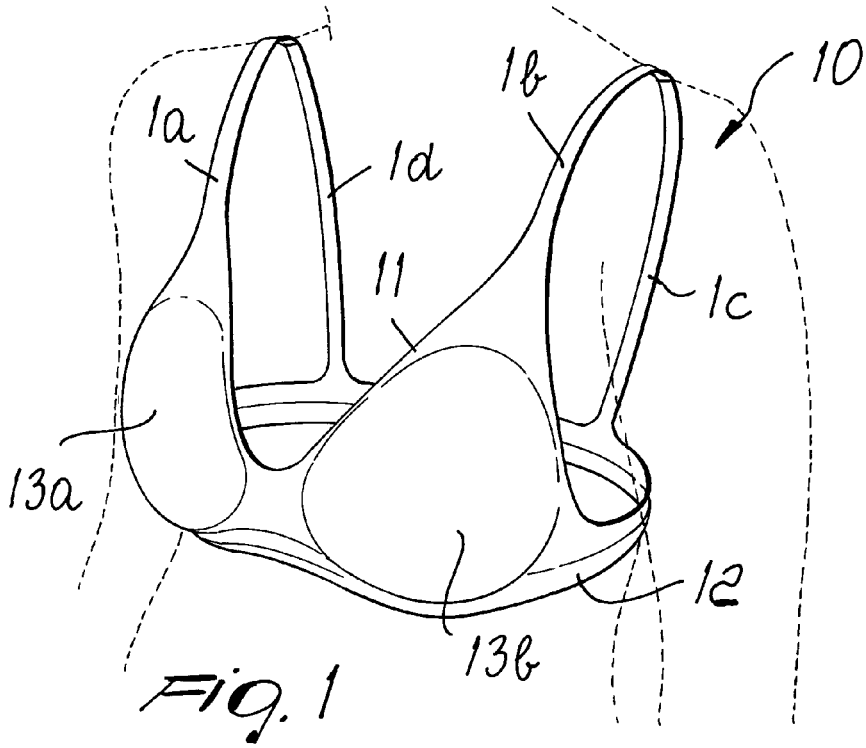
FIG. 1 is a view of a bra obtained with an article produced with the method according to the invention.

If one wishes to obtain an undershirt with bra cups 23*a*, 23*b*, after forming the tabs 2*a*-2*d* and a tubular portion of knitting 21 one proceeds as described for the production of the cups 13*a*, 13*b* of the bra of FIGS. 1 and 2. In FIG. 4, the rows of knitting that correspond to the rows 14 of FIG. 2 have been designated by the reference numeral 26.

If required, after forming another tubular portion of knitting 22, provided like the tubular portion 21, the article can be enhanced by forming pockets or pocket-like regions 25*a*, 25*b*, which are produced in a manner similar to the production of the cups 13*a*, 13*b* or 23*a*, 23*b*, with the difference that the number of needles of one or more sectors of the needle cylinder, depending on the number of pockets to be produced, that are moved so as to knit at the corresponding feed is gradually first decreased and then increased, retaining the last formed loop of knitting in the hook of the needles that are gradually excluded from knitting and pass with their hook below the knockover plane of the sinkers of the machine and then resume knitting when the number of active needles is increased. In this manner, the needles of the sector or sectors that are used form rows of knitting in excess with respect to the other needles of the machine, forming one or more pouches, which can be folded inwardly toward the reverse side of the article, obtaining one or more pockets 25*a*, 25*b*.

The knitting of the article is then completed with a further tubular portion of knitting 24, which constitutes the knitting completion border. Said knitting completion border can be produced in a per se known manner as a double folded border.

The article is then disengaged from the needles and unloaded from the machine. To complete the undershirt 20, it is sufficient to join, by sewing, the ends of the tabs 2*a*, 2*d* and 2*b*, 2*c* in order to close the shoulder straps.

Figure 6:
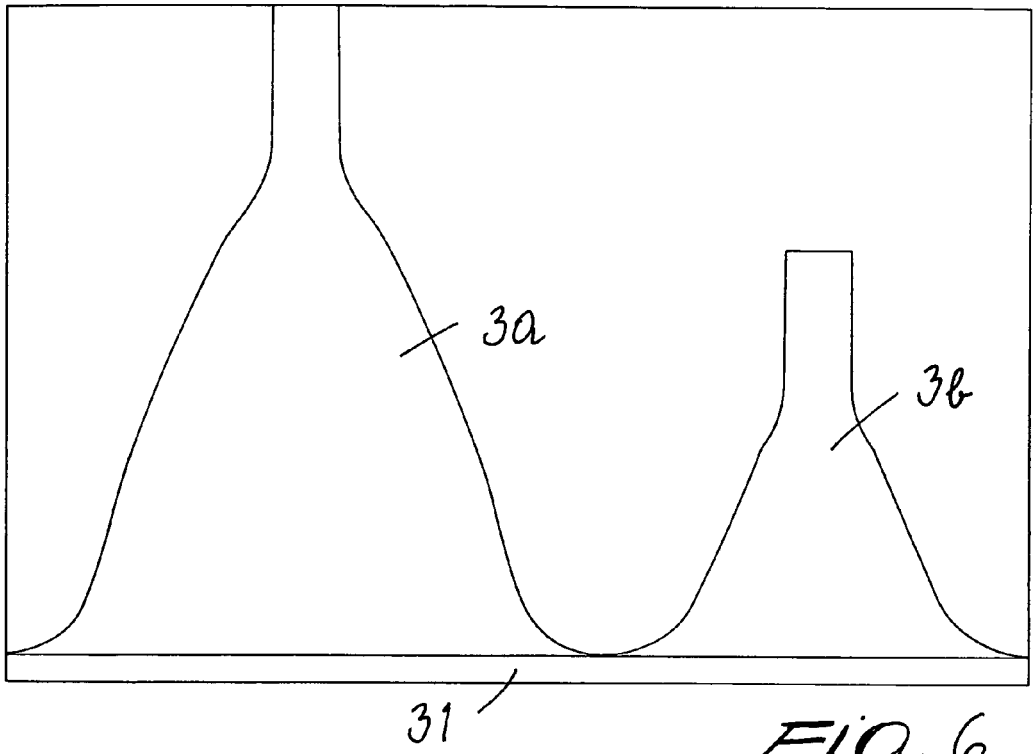
FIG. 6 is a diagram of the production of the article for forming the pair of underpants of FIG. 5.
Figure 5:
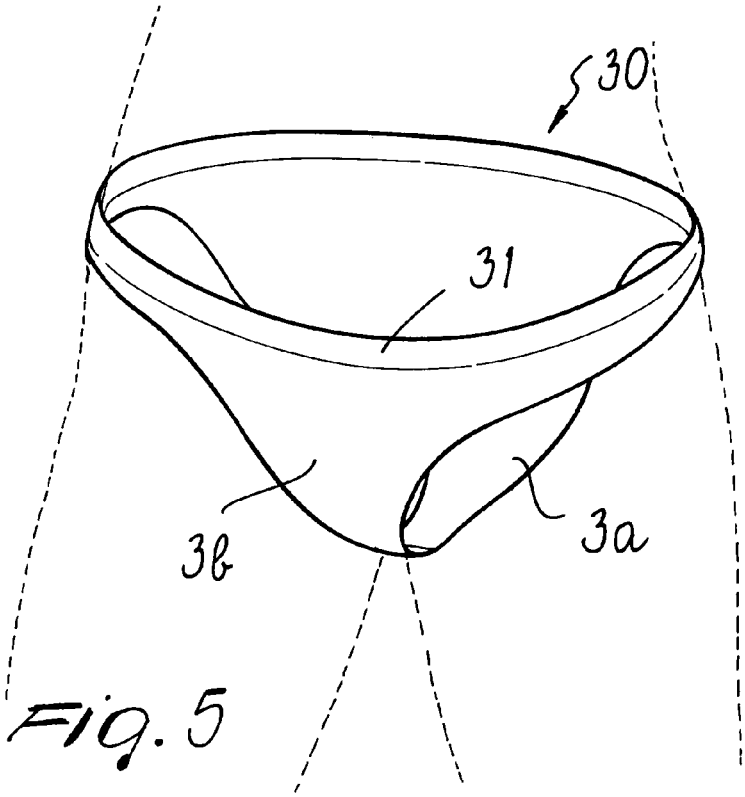
FIG. 5 is a view of a pair of underpants obtained with an article produced with the method according to the invention.

With particular reference to FIGS. 5 and 6, one proceeds as follows to produce an article for forming a pair of underpants 30.

Initially, by using all or some of the needles that belong to a sector of the needle cylinder, the tab 3*a* is formed by actuating the needle cylinder with an alternating rotary motion about its own axis and by moving to knit all or some of the needles of this sector at a feed of the machine. During the formation of the tab 3*a*, the number of needles of this sector or the breadth of the sector is gradually increased so as to achieve a gradual increase in the width of the tab 3*a*. After a number of rows of knitting formed with the needles that belong to this sector, all or some of the needles of another sector of the needle cylinder, which is angularly spaced with respect to the first sector, are moved to knit at another feed of the machine in order to form the other tab 3*b*. The method for producing the tabs 3*a* and 3*b*, including any execution of particular knitting with selection of the needles moved to knit proximate to the ends of the sectors of the active needles, is similar to the one already described with reference to the production of the tabs 1*a*-1*d* of FIGS. 1 and 2.

A tubular portion of knitting 31 is then formed by using all the needles of the machine or part of the needles of the machine, which are distributed along the entire circumferential extension of the needle cylinder. The tubular portion 31 is produced by using all or some of the feeds of the machine, by actuating the needle cylinder with a continuous rotary motion about its own axis. This tubular portion 31, whose height can vary according to the requirements, constitutes a knitting completion border and can be provided entirely or partially as a double folded border, which constitutes the band or elastic of the underpants.

The article is then abandoned by the needles and unloaded from the machine. To obtain the pair of underpants 30, it is sufficient to sew together the free ends of the tabs 3*a*, 3*b* in order to close the crotch region of the underpants.

Depending on the type of item of clothing to be provided, all or part of the threads used to produce the article may be optionally pretensioned elastic threads.

During the knitting of the article it is possible to perform, in a per se known manner, particular types of knitting and/or patterns meant to further improve the aesthetic appearance of the product.

In practice it has been found that the method according to the invention fully achieves the intended aim, since it allows to produce, with a circular knitting machine, articles for forming items such as body suits, sleeveless tops, undershirts, bras, underpants or the like, without lateral seams and with tabs that can constitute for example the shoulder straps of the item of clothing or the rear and front regions of underpants and are already finished at their lateral edges without requiring further finishing operations.

Another advantage of the method according to the invention is that it does not generate waste in the production of articles with tabs, as specified above, and therefore allows significant savings on the production costs of items of clothing if the materials used are unchanged.

The method thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2003A001368 from which this application claims priority are incorporated herein by reference.

The invention claimed is:

1. A method for manufacturing knitted articles for forming items of clothing without lateral seams, with a circular knitting machine, comprising at least one step for forming tabs, in which all or part of the needles of the machine are arranged in sectors of the needle cylinder that are angularly spaced from each other around the axis of the needle cylinder, each of said sectors being correlated to a respective feed of the machine, at which at least some of the needles of that given sector are moved to knit, and the needle cylinder of the machine is actuated with an alternating rotary motion about its own axis, with an extent of oscillation that is sufficient to make all the needles of each sector pass at the respective feed, in order to make the needles of said sector that are moved to knit at said feed form a preset number of rows of knitting, wherein the number of needles of said sector that are moved to knit at said feed is change according to a preset program.

2. The method of claim 1, wherein in addition to said step for forming tabs at least one step for forming a tubular portion of knitting, in which needles distributed along an entire circumferential extension of the needle cylinder of the machine are moved to knit at at least one feed or drop of the machine, is carried out either before or after said tab forming step.

3. The method of claim 2, wherein said step for forming a tubular portion of knitting is performed by actuating the needle cylinder with a continuous rotary motion about its own axis.

4. The method of claim 1, wherein during said tab forming step a preset number of needles located proximate to ends of said given sector is actuated at said respective feed with a selection with needles in a one-to-one inactive configuration.

5. The method of claim 1, wherein during said tab forming step a preset number of needles located proximate to ends of said given sector is actuated at said respective feed with a selection with needles in a one-to-one tuck-stitch position.

6. A method for producing knitted articles for forming items of clothing with shoulder straps, as set forth in claim 1, wherein said tabs constitute the shoulder straps of an item of clothing, the method comprising:

a step for forming the shoulder straps, in which needles that belong to four sectors of the needle cylinder that are angularly spaced from each other around the needle cylinder axis are moved to knit at a different feed for each one of said sectors, and the needle cylinder is actuated with an alternating rotary motion about its own axis with an extent of oscillation that is such as to produce the transit, in front of the corresponding feed, of all the needles of the correlated sector that are moved to knit;

a step for forming the remaining part of the article, which comprises at least one step for forming at least one tubular portion of knitting by moving so as to knit, at at least one feed or drop of the machine, all or some of the needles of the needle cylinder that are distributed along the entire circumferential extension of the needle cylinder, and the needle cylinder is actuated with a continuous rotary motion about its own axis.

7. A method for producing knitted articles for providing items of clothing in the form of underpants as set forth in claim 1, wherein said tabs constitute front and rear regions of the underpants arranged between leg cuts, comprising:

a step for forming the front and rear region of the underpants, in which needles that belong to two sectors of the needle cylinder that are angularly spaced from each other around the needle cylinder axis are moved to knit at a different feed for each one of said sectors, and the needle cylinder is actuated with an alternating rotary motion about its own axis with an extent of oscillation that is such as to produce the transit, in front of the corresponding feed, of all the needles of the correlated sector that are moved to knit;

a step for forming the remaining part of the article, which comprises at least one step for forming at least one tubular portion of knitting by moving so as to knit, at at least one feed or drop of the machine, all or some of the needles of the needle cylinder that are distributed along the entire circumferential extension of the needle cylinder, and the needle cylinder is actuated with a continuous rotary motion about its own axis.

8. The method of claim 6, wherein said step for forming the remaining part of the article comprises a step for forming pocket regions, in which some or all of the needles that belong to at least one sector of the needle cylinder are moved to knit at at least one feed of the machine, actuating the needle cylinder of the machine with an alternating motion about its own axis, with an extent of oscillation that is sufficient to produce the transit, at said at least one feed, of all the needles of said at least one sector that are moved to knit at said at least one feed, in order to form, with the needles that belong to said at least one sector, a number of rows of knitting in excess with respect to the number of rows of knitting formed by the needles that do not belong to said sector.

9. The method of claim 8, wherein during said step for forming pocket regions some rows of knitting are also formed by moving to knit, at said at least one feed, some or all of the needles distributed along the entire circumferential extension of the needle cylinder.

10. The method of claim 9, wherein during said step for forming pocket regions the number of needles that belong to said sector and are moved to knit at the corresponding feed is increased gradually.

11. The method of claim 9, wherein during said step for forming pocket regions the number of needles that belong to said sector and are moved to knit at the corresponding feed is decreased gradually.

12. The method of claim 7, comprising the forming of a double folded knitting completion border.

* * * * *